US005946890A

United States Patent [19]

Focke et al.

[11] Patent Number: 5,946,890

[45] Date of Patent: Sep. 7, 1999

[54] SOFT CASE PACKET PLUS METHOD AND DEVICE FOR MANUFACTURING SAME AND OTHER PACKETS

[75] Inventors: Heinz Focke, Verden; Thomas Häfker, Langwedel; Hans Jürgen Bretthauer, Bremen, all of Germany

[73] Assignee: Focke & Co. (GmbH & Co.), Verden, Germany

[21] Appl. No.: 08/946,654

[22] Filed: Oct. 7, 1997

[30] Foreign Application Priority Data

Oct. 7, 1996 [DE] Germany ..... 196 41 151

[51] Int. Cl.[6] ..... B65B 11/00

[52] U.S. Cl. ..... 53/466; 53/491; 53/234; 53/236; 53/228; 53/376.5

[58] Field of Search ..... 53/466, 491, 234, 53/376.5, 383.1, 236, 228, 232, 233

[56] References Cited

U.S. PATENT DOCUMENTS

| | | | |
|---|---|---|---|
| 4,838,846 | 6/1989 | Focke et al. | 53/234 |
| 4,840,007 | 6/1989 | Focke et al. | 53/234 |
| 4,916,884 | 4/1990 | Focke et al. | 53/466 |
| 4,918,908 | 4/1990 | Focke et al. | 53/234 |
| 4,942,715 | 7/1990 | Focke | 53/234 |
| 5,058,363 | 10/1991 | Focke et al. | 53/466 |
| 5,357,734 | 10/1994 | Focke et al. | 53/234 |
| 5,537,806 | 7/1996 | Grierson et al. | 53/491 |
| 5,732,533 | 3/1998 | Focke et al. | 53/466 |

FOREIGN PATENT DOCUMENTS

| | | |
|---|---|---|
| 275887 | 7/1988 | European Pat. Off. . |
| 2055016 | 1/1973 | Germany . |
| 3701427 | 7/1988 | Germany . |
| 4241176 | 6/1994 | Germany . |
| 3541101 | 2/1995 | Germany . |
| 19604888 | 8/1996 | Germany . |
| 895114 | 5/1962 | United Kingdom . |

*Primary Examiner*—James F. Coan
*Assistant Examiner*—Gene L. Kim
*Attorney, Agent, or Firm*—Sughrue, Mion, Zinn, Macpeak & Seas, PLLC

[57] ABSTRACT

Soft-case packet plus method and device for manufacturing same and other packets. On soft-case packets for cigarettes, blanks for an inner wrapping (17) and an outer soft pouch (18) made of paper or the like are folded in usual fashion on a hollow folding mandrel (10) of a rotary folding unit (12). Folding flaps of the soft pouch (18) are connected to one another by glue in the region of a side wall (23) and in the region of a base. The glue is applied by glue nozzles during the manufacture of the packet as a row of glue spots (26, 41) to the respective folding flaps, i.e. to an inner flap (24) lying radially on the outside in relation to the rotary folding unit (12) and to the inner side of an outer base flap (39) extending in the direction of the perimeter.

11 Claims, 9 Drawing Sheets

SOFT CASE PACKET PLUS METHOD AND DEVICE FOR MANUFACTURING SAME AND OTHER PACKETS

BACKGROUND OF THE INVENTION

The invention relates to a soft-case packet for cigarettes or the like, in which the packet contents—a group of cigarettes—is completely surrounded by an inner blank made of paper, tin foil or the like, and a block of cigarettes formed in this way is received in a soft pouch made of thin packaging material, especially paper, and open at the top, said soft pouch having in the region of at least one narrow side wall side flaps, partially overlapping and glued to one another, and in the region of a base wall base flaps likewise (partially) overlapping and glued to one another. In addition, the invention relates to a method and device for manufacturing soft-case packets of this kind, but also other packets made of soft packaging material, for example thin cardboard.

Soft-case packets are amongst the most common forms of packets for cigarettes. The (soft) pouch generally consisting of paper is formed in the region of a narrow upright side wall and in the region of the base by folding flaps which partially overlap. These folding flaps are attached to one another by being glued. On the previously known packets of this type, strip-shaped gluing patterns are applied to the glued folding flaps. The gluing process is time-consuming and therefore a problem for packaging machines of high capacity.

SUMMARY OF THE INVENTION

The purpose underlying the invention is to improve the productive capacity of the machine by an improved packet design and by special measures in the production of packets.

In fulfillment of this purpose, the soft-case packet according to the invention is characterised in that the side flaps and/or base flaps are glued to one another by glue spots, especially by a number of glue spots extending in the longitudinal direction of the respective folding flaps and arranged at a spacing from one another.

The use of spot-shaped glue patterns firstly makes possible a precise and therefore glue-saving positioning of the gluing points. In addition to this, the glue spots can be applied at high speed, namely by glue nozzles which spray on the spot-shaped glue patterns. The glue spots are here preferably arranged in a row in the longitudinal direction of the respective folding flaps.

A further subject of the invention includes process steps and details of a device for producing packets from foldable material. The starting point for this is a folding assembly, especially a rotary folding unit, on which the blanks for making the packet are first laid in a U-shape around a folding mandrel, such that folding flaps, namely side flaps, for forming a side wall of the packet protrude over the folding mandrel on the rear side in the conveying direction. According to the invention, the folding flap—inner flap—lying radially on the outside is provided on the outside with glue spots, preferably during the continuous movement of the folding mandrel. Subsequently, the inner flap provided with glue spots is then folded against the rear side of the folding mandrel and then the outer flap lying radially on the inside is folded against the inner flap and connected with same by the glue spots. All the glue spots are applied simultaneously by a gluing assembly with a number of glue nozzles corresponding to the number of glue spots.

Also in the region of a base wall or a wall with folding flaps extending in the movement direction of the folding mandrel, glue points are applied to said flap, according to the invention by a gluing assembly with a single nozzle which, during the preferably continuous movement of the folding mandrel, is actuated several times in succession and thereby applies gluing spots arranged at a spacing from one another to the folding flap.

Further features of the invention relate to the positioning of the gluing assemblies, to the placing and method of operation of folding members as well as to guide members for the partially folded packets or blanks.

Details of the packet as well as of the device and the method are explained in greater detail below with the aid of the embodiments, given by way of example and shown in the drawings. These show:

DESCRIPTION OF PREFERRED EMBODIMENTS

Figure 2:
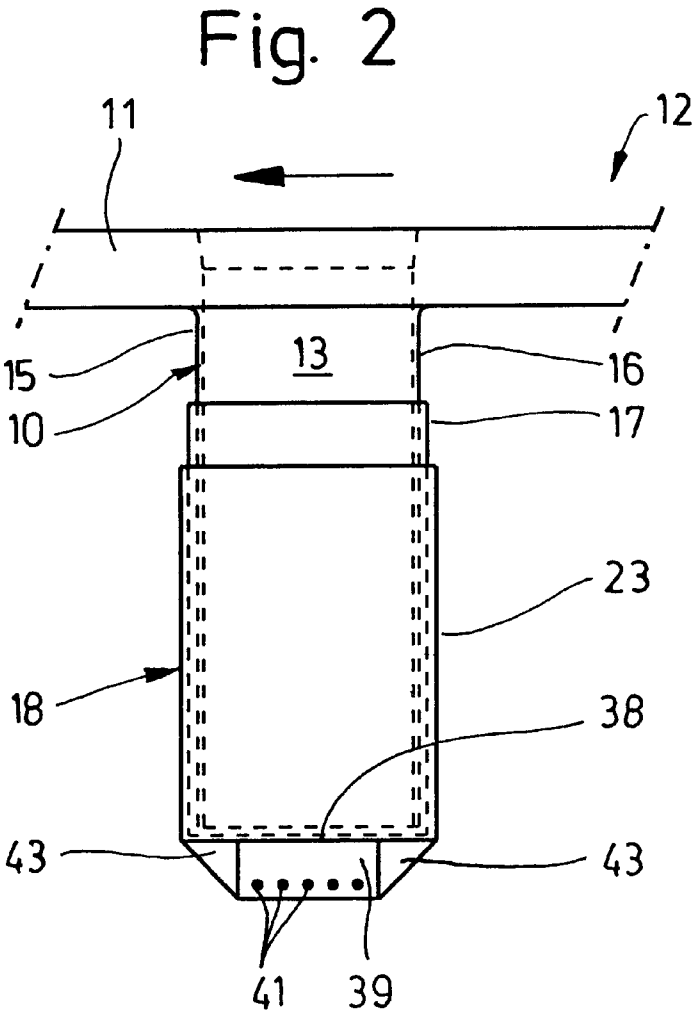
Figure 1:
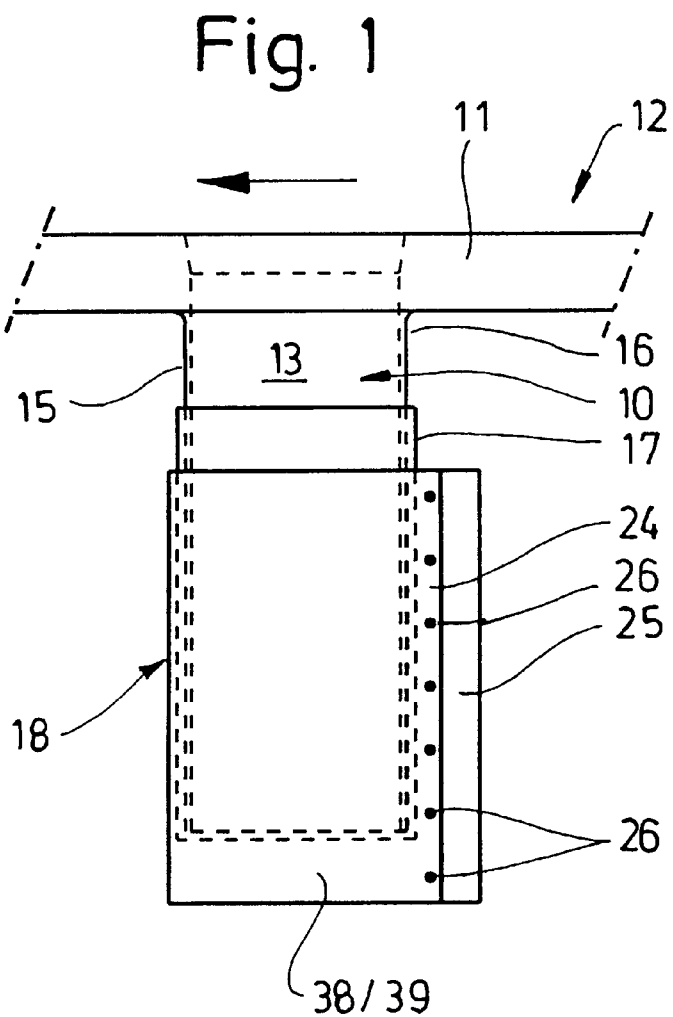
FIG. 1 a folding mandrel as part of a rotary folding unit with details of a soft-case packet during the manufacture of same, in plan view, FIG. 2 a view analogous to FIG. 1 during a further production step, FIG. 3 a folding mandrel in longitudinal section and on an enlarged scale, in a cutting plane III—III of FIG. 4, FIG. 4 a perimeter region or detail of a rotary folding unit with a plurality of folding mandrels in side view, FIG. 5 a partial region of the view according to FIG. 4, namely a gluing station, on an enlarged scale, FIG. 6 the gluing station according FIG. 5 in cross-sectional view or as a cross-section in the plane VI—VI of FIG. 4, FIG. 7 a further detail of the view according to FIG. 4, namely a folding station, on an enlarged scale, FIG. 8 the folding station according to FIG. 7 in cross-sectional view or in the cross-section VIII—VIII of FIG. 4, FIG. 9 a further partial region of FIG. 4, namely a (second) gluing station on an enlarged scale, FIG. 10 the gluing station according to FIG. 9 in cross-sectional view or in the cross-section of plane X—X in FIG. 4.

The details shown in the drawings primarily concern the production of soft-case packets for cigarettes or other objects. This type of packet is manufactured with the use of a folding mandrel 10. Said mandrel is a hollow, tube-like member which is attached on one side to a support member 11 of a rotary folding unit 12. The folding mandrel 10 has a cross-section corresponding to the inner space of the packet, in the present case a rectangular cross-section. A plurality of folding mandrels 10 are arranged at equal distances from one another along the perimeter of the rotary folding unit 12. The folding mandrels 10 are positioned in such a way that a large-surface outer wall 13 runs outwards, and a corresponding inner wall 14 inwards, in relation to the radial direction of the revolving unit. A narrow front wall 15 and a corresponding rear wall 16 are directed approximately radially.

Figure 3:
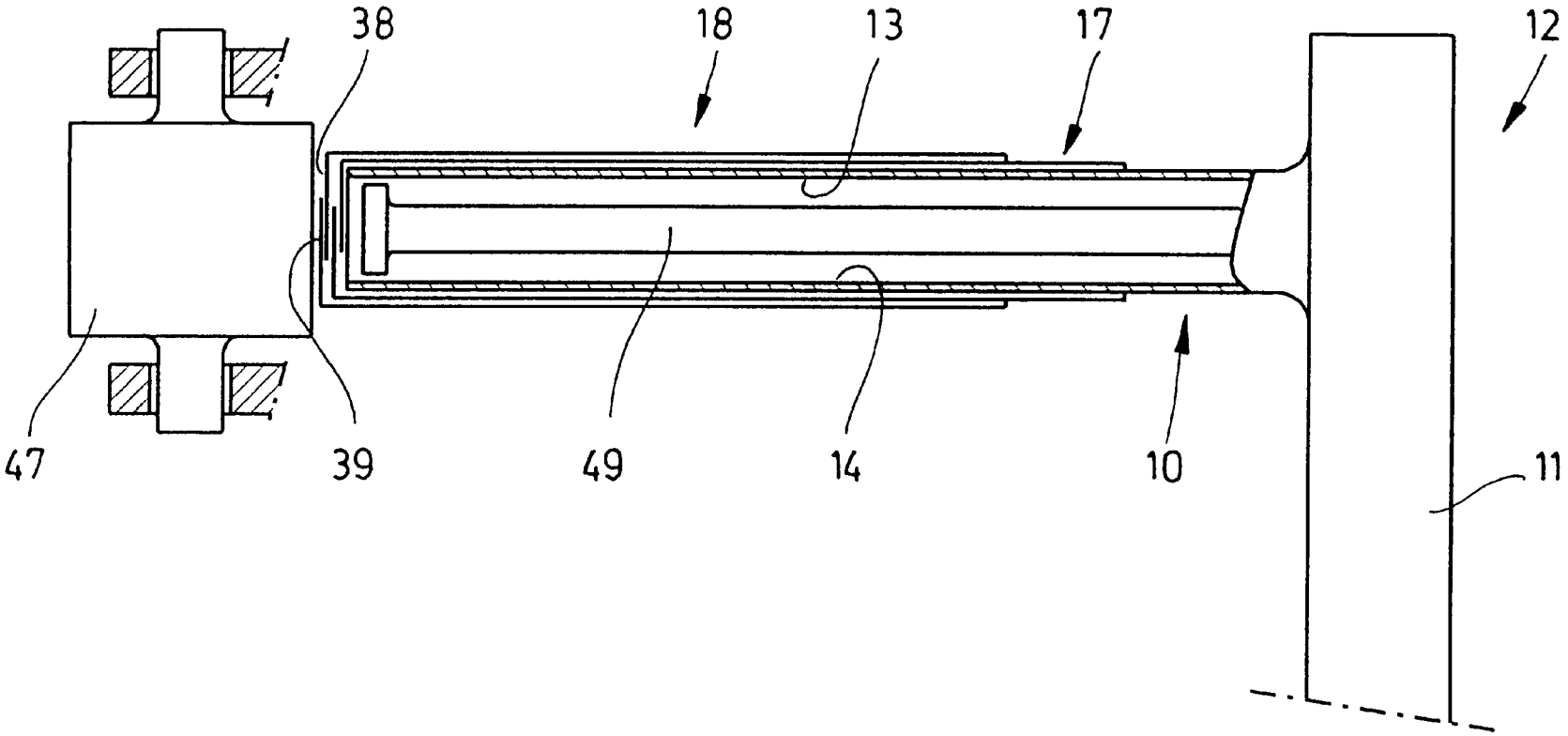
Figure 4:
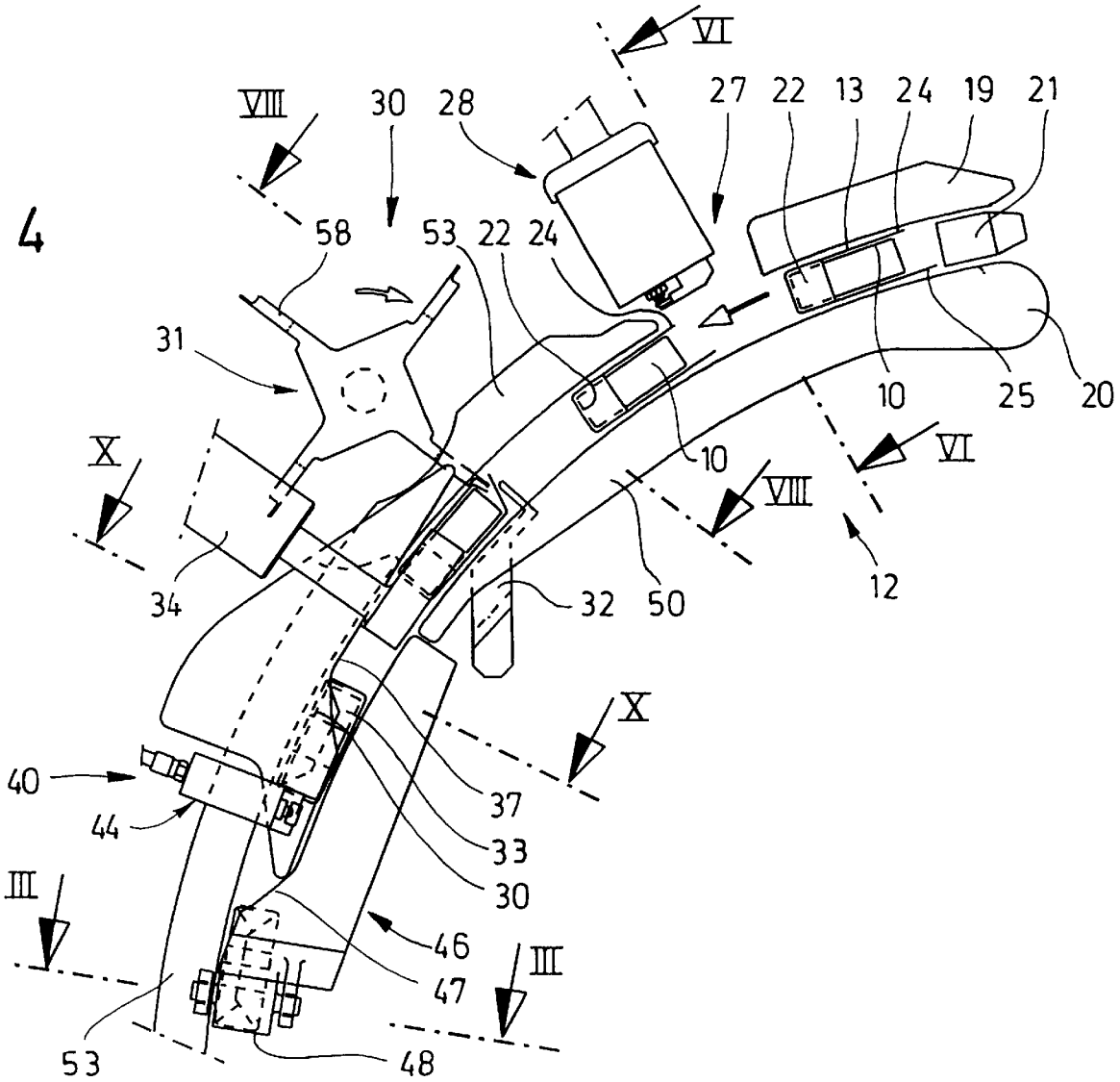
Figure 5:
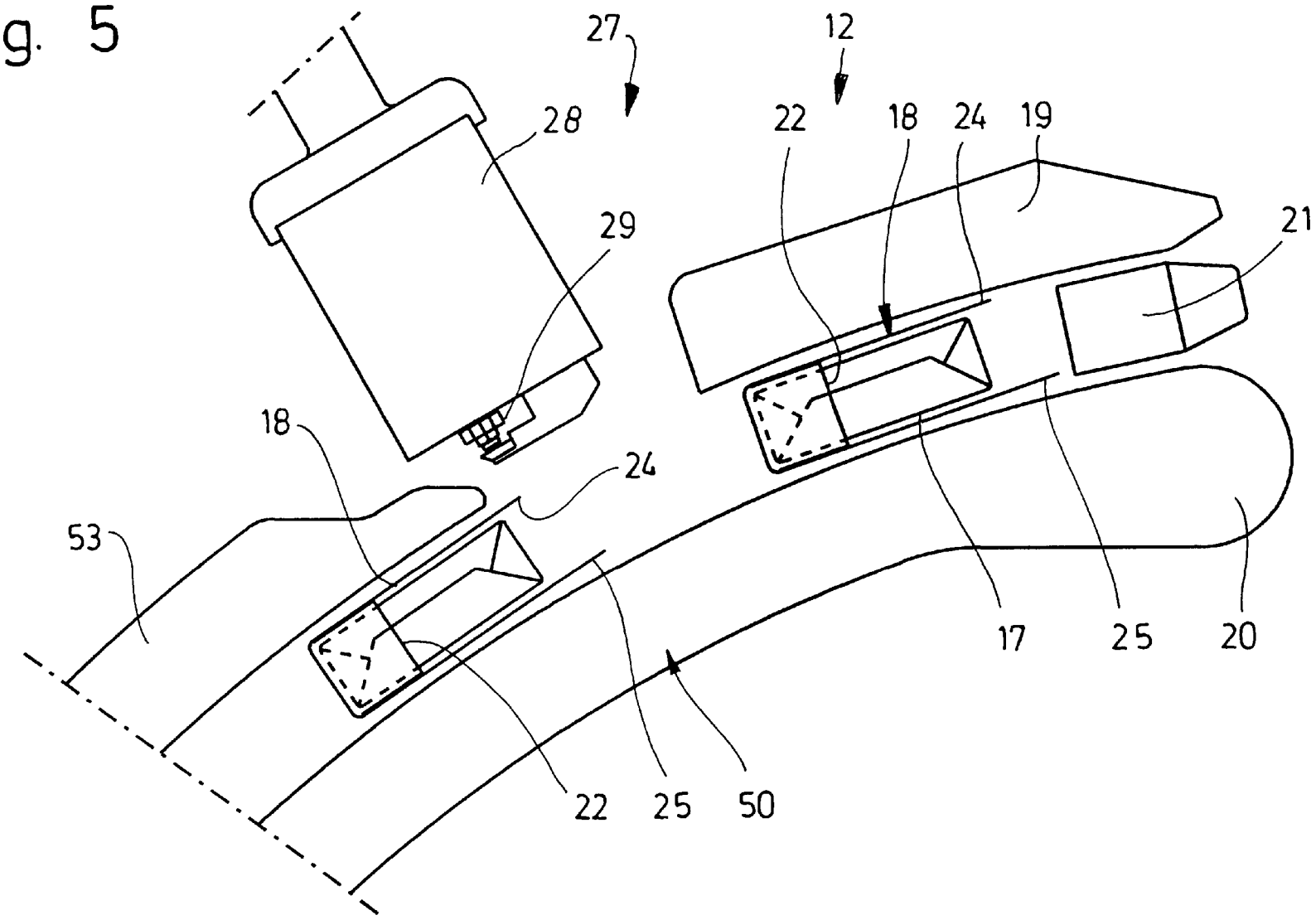

The blanks forming the packet are folded in succession on the outer side of the folding mandrel 10. First of all, an inner wrapping 17 is folded and then—on the outside of same—the outer wrapping, namely a (paper) blank for the soft pouch 18. The details described below and shown in the drawings are related primarily to the manufacture of this soft pouch 18, i.e. the outer wrapping of the packet. A base wall of the inner wrapping 17 formed from folding flaps is only shown in the drawings in FIG. 3 and in FIG. 5.

A blank for the soft pouch 18 is held ready in a position directed radially to the rotary folding unit 12 between successive folding mandrels 10 and taken by the next folding mandrel in the conveying direction. In the region of first fixed U-shaped folding members 19, 20, lying radially on the outside and on the inside, the blank of the soft pouch 18 is folded in a U-shape around the folding mandrel 10, this being accomplished by the movement of the folding mandrel 10 with the blank relative to the fixed U-shaped folding members 19, 20. At the same time, a base edge flap 22 is folded round in this station by a stationary folding finger 21 against the free surface of the folding mandrel 10.

The blank for the soft pouch 18 is made of such dimensions and is held ready relative to the folding mandrel 10 in such a way that, after the U-shaped folding on the side of the folding mandrel with its back to the direction of transport, i.e. in the region of the rear wall 16, folding flaps project to form a side wall 23 of the soft pouch 18. In the present case these are side flaps, namely a (narrower) inner flap 24 and a (broader) outer flap 25. The inner flap 24 lies on the inner side of the side wall 23 of the packet, once said side wall has been completely folded, and is at least partially overlapped by the outer flap 25.

On the finished packet, inner flap 24 and outer flap 25 are connected to one another by gluing. This connection is effected by glue spots 26 which are applied to one of the side flaps, in the present case to the outer side of the inner flap 24. To produce the side wall 23, once the glue spots 26 have been applied, the inner flap 24 is folded round against the outer side of the rear wall 16 of the folding mandrel 10, and then the outer flap 25 is folded against the inner flap 24 by a folding movement guided outwards.

The glue connection of inner flap 24 and outer flap 25 consists in a row of glue spots 26 arranged at preferably equal spacings from one another. Taking into account the dimensions of the packet, seven glue spots are expedient. The latter extend along the complete longitudinal dimension of the blank or the inner flap 24. One glue spot 26 lies also in the region of a base wall of the packet or soft pouch 18.

The glue spots 26 are applied in the region of a gluing station 27 to the side of the inner flap 24 directed radially outwards, this happening during continuous movement of the rotary folding unit 12 and thus of the folding mandrel 10. In the region of the gluing station 27, a gluing assembly 28 is arranged stationary outside the movement region of the rotary folding unit 12 or of the folding mandrels 10 arranged on the outer edge of same. This gluing assembly consists of a plurality of glue nozzles 29 arranged beside one another in an axial direction. In the present embodiment, given by way of example (FIG. 6), the gluing assembly 28 consists of 7 glue nozzles 29 which each transfer one glue spot 26 to the blank. The glue nozzles 29 are arranged at a slight distance from the movement path of the folding mandrels 10, in such a way that the nozzles 29 point in a radial direction, i.e. transversely to the plane of the inner flap 24. The glue assembly 28 or its glue nozzles 29 are controlled in dependence on the movement of the folding mandrel 10 in such a way that, whilst the inner flap 24 moves past, the (seven) glue spots 26 are transferred simultaneously to the folding flap by the glue nozzles.

The soft pouches 18, prepared by the application of the glue spots 26 and partially folded, are led by the folding mandrel 10 to a folding station 30. In the region of the latter, the inner flap 24, provided with glue spots is folded by a fixed movable folding member, namely folding wheel 31—during the continued rotation of the rotary folding unit 12—against the rear side of the folding mandrel 10, i.e. against the rear wall 16 of same.

At roughly the same time, the outer flap 25, lying inside in a radial direction, is folded by a folding means 32 likewise against the rear side of the folding mandrel 10 and thus against the inner flap 24 which has been folded immediately before. The outer flap 25 is here connected to the inner flap 24 via the glue spots 26. The folding means 32 is arranged on the rotary folding unit 12. Each folding mandrel 10 is accordingly associated with a folding means 32 rotating with the latter.

In the region of the folding station 30, once inner flap 24 and outer flap 25 have been folded, a further folding step is carried out. In the region of a base wall, regions of the side wall 23, which is formed from inner flap 24 and outer flap 25, projecting over the folding mandrel 10 are folded into the plane of the base wall, namely an edge flap 33 opposite the already folded edge flap 22. Edge flap 33 is folded by a fixed flap folding means 34, which has a finger 35 which may be swivelled round an approximately radially directed axis. This finger is actuated in such a way that, in an overtaking movement, edge flap 33 is folded round out of its extended position into the plane of the base wall or up to the base wall of the inner wrapping.

In the further course of the conveying movement, a fixed folding member 36 becomes effective, this member being configured as a folding switch point with a curved folding edge 37. This edge grasps a trapezoid base flap 38, lying radially on the outside, and folds same into the plane of the base wall or against the base of the inner wrapping. The base flap 38 projects over the free end of the folding mandrel 10 (FIG. 6) before the folding member 36 is folded round as a result of the movement of the folding mandrel 10 relative to the fixed folding edge 37.

A lower base flap 39 lying radially on the inside, but on the outside on the finished packet, is, during this phase, in an extended position, i.e. in extension of the inner wall 14 of the folding mandrel 10. In this partially folded position, the soft pouch 18 reaches with the folding mandrel 10 the region of a further (second) gluing station, namely the region of a base gluing station 40.

In the region of the base gluing station 40, the gluing of base folding flaps of the soft pouch 18 is carried out. In concrete terms, this means the application of glue spots 41 on the inner side of the base flap 39. What is involved here is the outer base flap 39, which after folding is adjacent to the inner base flap 38 and connected to the latter by gluing. The base of the soft pouch 18 is configured in the present case as an envelope-type fold. The trapezoid base flaps 38, 39 are adjacent at the side to the edge flaps 22, 33 folded first. Between the latter and base flaps 38, 39 extend triangular folding gussets 43. The glue spots 41 are applied exclusively in the region between the folding gussets 43 of the outer base flap 39 on the inner side of same. What is involved here is a row of glue spots 41, the row extending parallel to the direction of movement of the folding mandrel 10. The row consists here of five glue spots 41.

The glue spots are applied during the movement of the folding mandrel 10 and thus of base flap 39 by a gluing member 44 which consists of only one glue nozzle 45. This is positioned at the side beside the rotary folding unit 12 or the movement path of the folding mandrel 10, in a plane or axis at an oblique angle to the plane of the extended base flap 39. The glue nozzle 45 is actuated in synchronization with the rotation of the rotary folding device 12 such that the glue spots 41 are applied in succession to the base flap 39. The distances of the glue spots 41 from one another arise from the relationship of the conveying speed of the folding mandrel 10 to the cycle speed of the glue nozzle 45.

Once the base flap 39 has been glued, it is set upright, as the conveying movement is continued, by a base folding means 46 and folded against the inner base flap 38. The base folding means 46 is configured as a stationary folding switch point with a folding edge 47 which rises in the conveying direction and along which the base flap 39 slides.

The finished folding of the base wall is stabilized, subsequent to the base folding means, by a pressure member, namely by a pressure roller 48 mounted stationary. This roller is mounted stationary at the side beside the movement path of the folding mandrels 10. The folded base is moved past the pressure roller 48 by the movement of the folding mandrels 10, said pressure roller stabilizing the base flaps 38 and 39 in their folds and in respect of their glue connection. To improve the pressure effect, in the present case there is arranged inside the folding mandrel 10 a ram 49, the plate of which ram is adjacent to the inner side of the base of the soft pouch 18 or the inner wrapping 17 and acts as a counter-pressure member for the pressure roller 48. The ram 49 has at the same time the task of leading the packet contents into the folding mandrel 10, i.e. a group of cigarettes (not shown).

Figure 6:
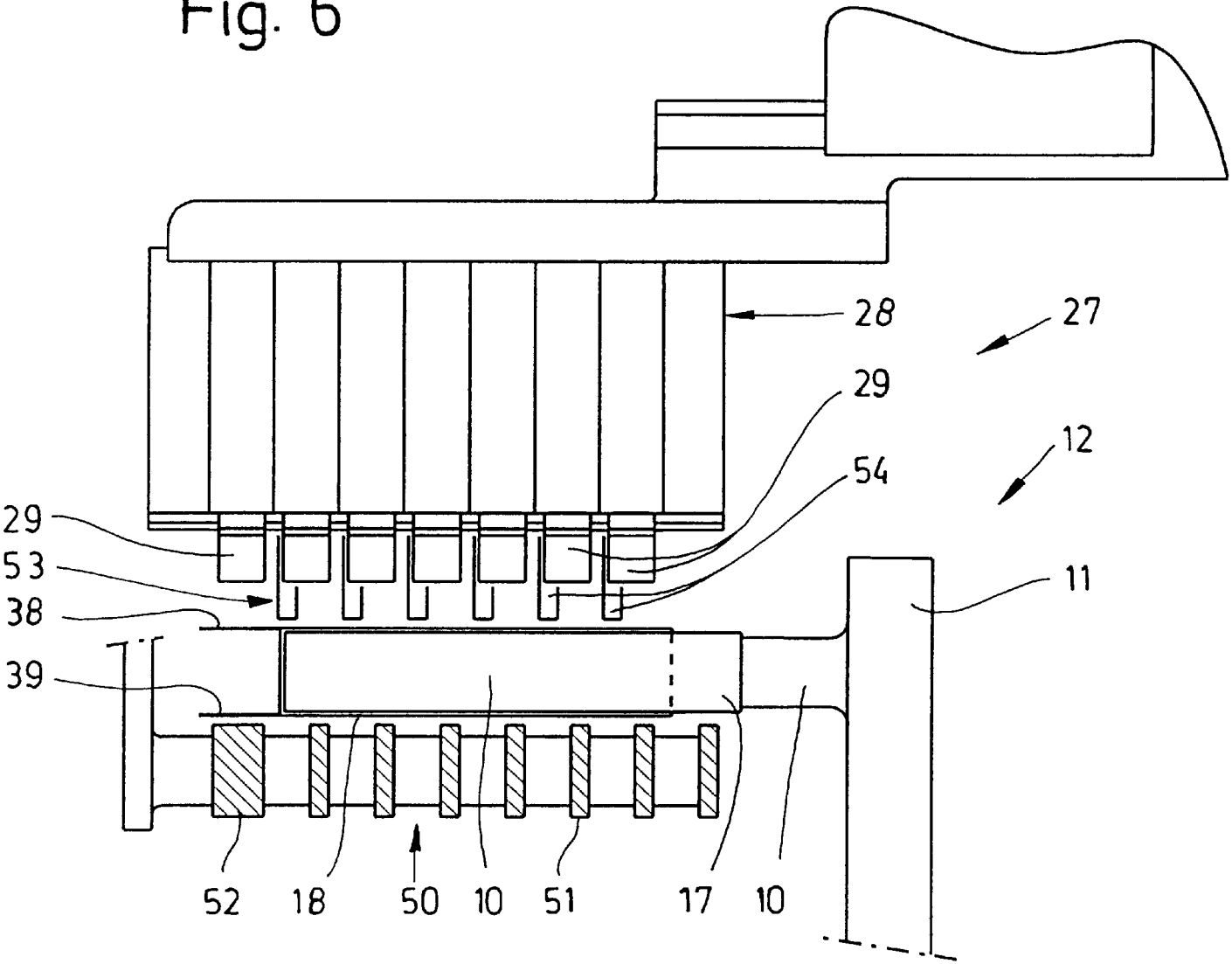
Figure 7:
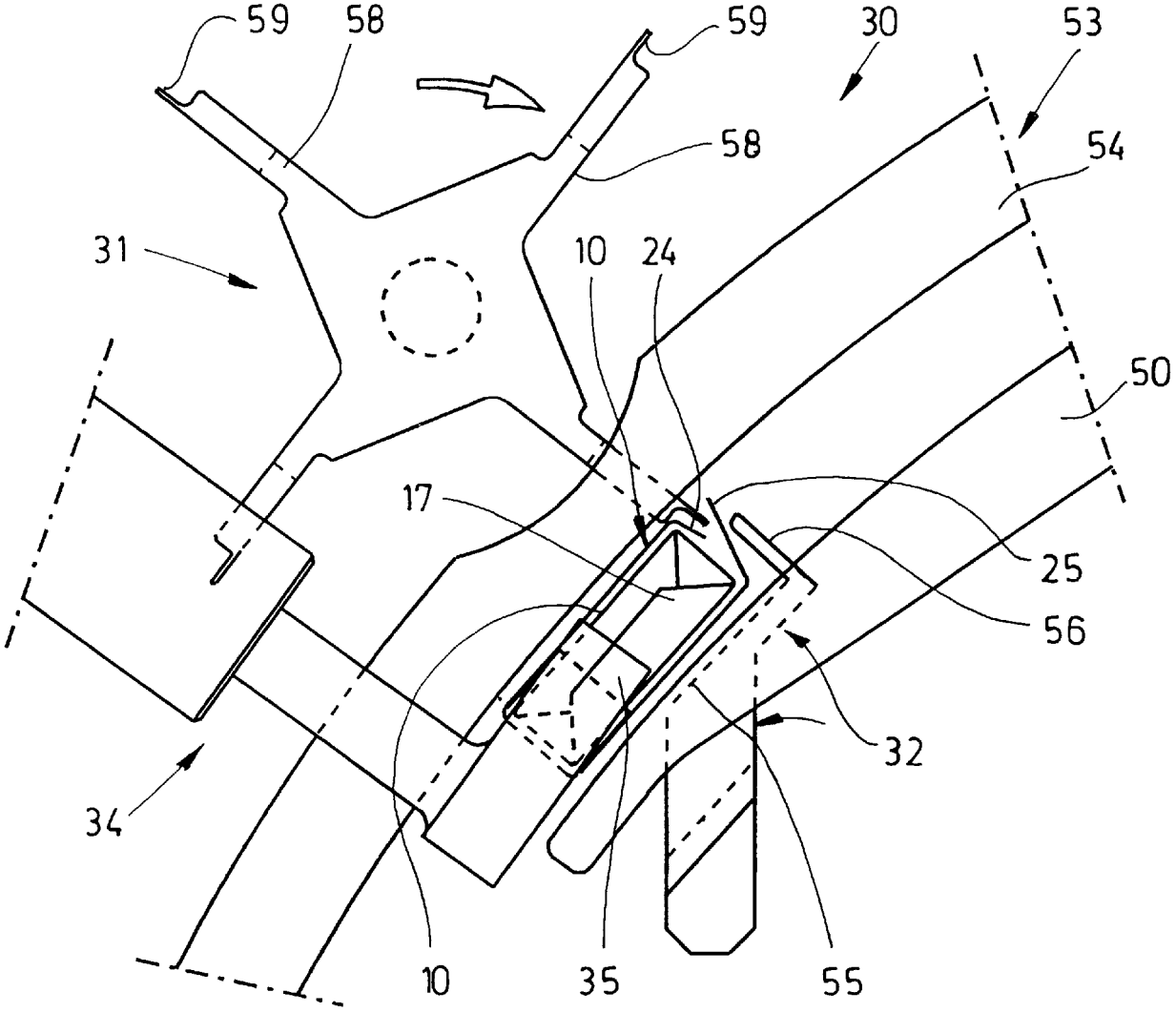

For the functioning of the described members, special features of the rotary folding unit 12 are advantageous. Thus, along the movement path of the folding mandrels 10, on the outer and inner sides in a radial direction, guide members are provided which consist predominantly of a plurality of parallel ribs or webs. Thus the U-shaped folding member 20, lying radially on the inside, is configured in its continuation as a support 50 which is radially inside. The inner leg of the blank, folded in a U-shape, is adjacent to this support 50. The latter consists of a plurality of webs 51 arranged at a spacing from one another (FIG. 6). A web 52, lying on the outside, is configured with a greater width than the remaining webs 51 in order to form a greater support surface for the lower or radially inside base flap 39.

The upper or radially external U-shaped folding member 19 is configured correspondingly, however only extends over a short perimeter section of the rotary folding unit 12. At a distance from the U-shaped folding member 19 there follows in the direction of the perimeter an external guide 53 which is likewise formed from parallel webs 54. The webs 54 are arranged in planes off-set roughly centrally to the webs 51, 52 of the support 50. The gluing assembly 28 is positioned in the region of a gap between U-shaped folding member 19 and external guide 53.

Folding members are adapted in their design to the support 50 or external guide 53. Thus the folding means 32, associated with each folding mandrel 10 and rotating with the rotary folding unit 12, is configured angular, namely with a support surface 55 lying radially on the inside and a folding leg 56 pointing roughly in a radial direction. The latter, on a corresponding relative movement from inside to outside, grasps the outer flap 25 and folds same against the rear side of the folding mandrel 10. The folding means 32 consisting of support surface 55 and folding leg 56 is configured predominantly like a comb, consisting of a plurality of folding webs 57. These webs extend respectively in the region between the webs 51, 52 of the support 50. The folding means 32 can thus be moved through the region of the support 50.

The folding member positioned on the outer side of the rotary folding unit 12, namely folding wheel 31, is configured in analogous fashion to this. The folding wheel consists in the present case of four folding wings 58. These folding means, arranged in equal peripheral distances from one another, are driven to rotate around an axis parallel to the axis of the rotary folding unit 12. One after the other, the folding wings 58 plunge into the movement region of the folding mandrels 10, the inner flap 24 being folded by folding fingers 59 on the end of the folding wings 58. The end region of the folding wings—including the folding fingers 59—is likewise configured angular.

Figure 8:
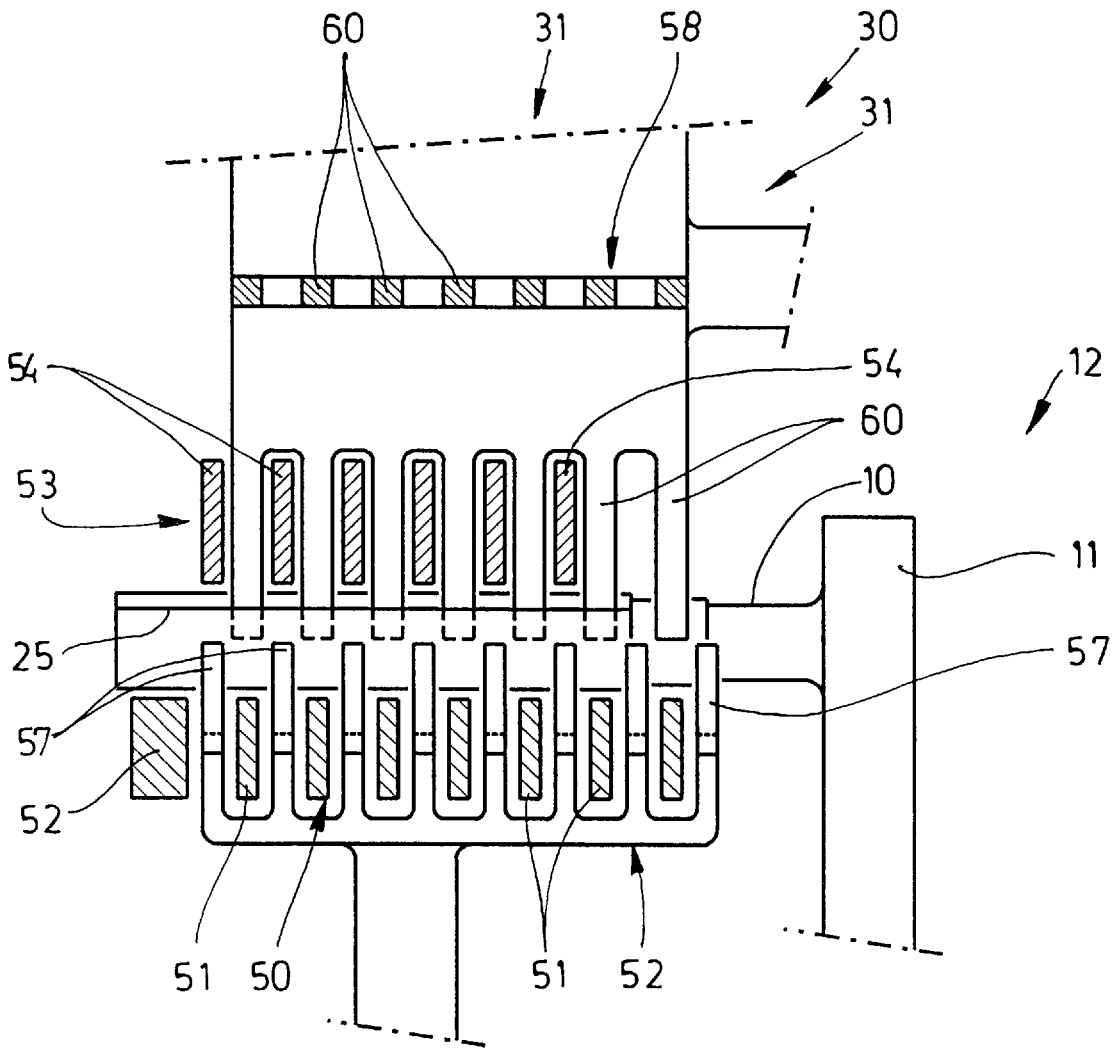
Figure 9:
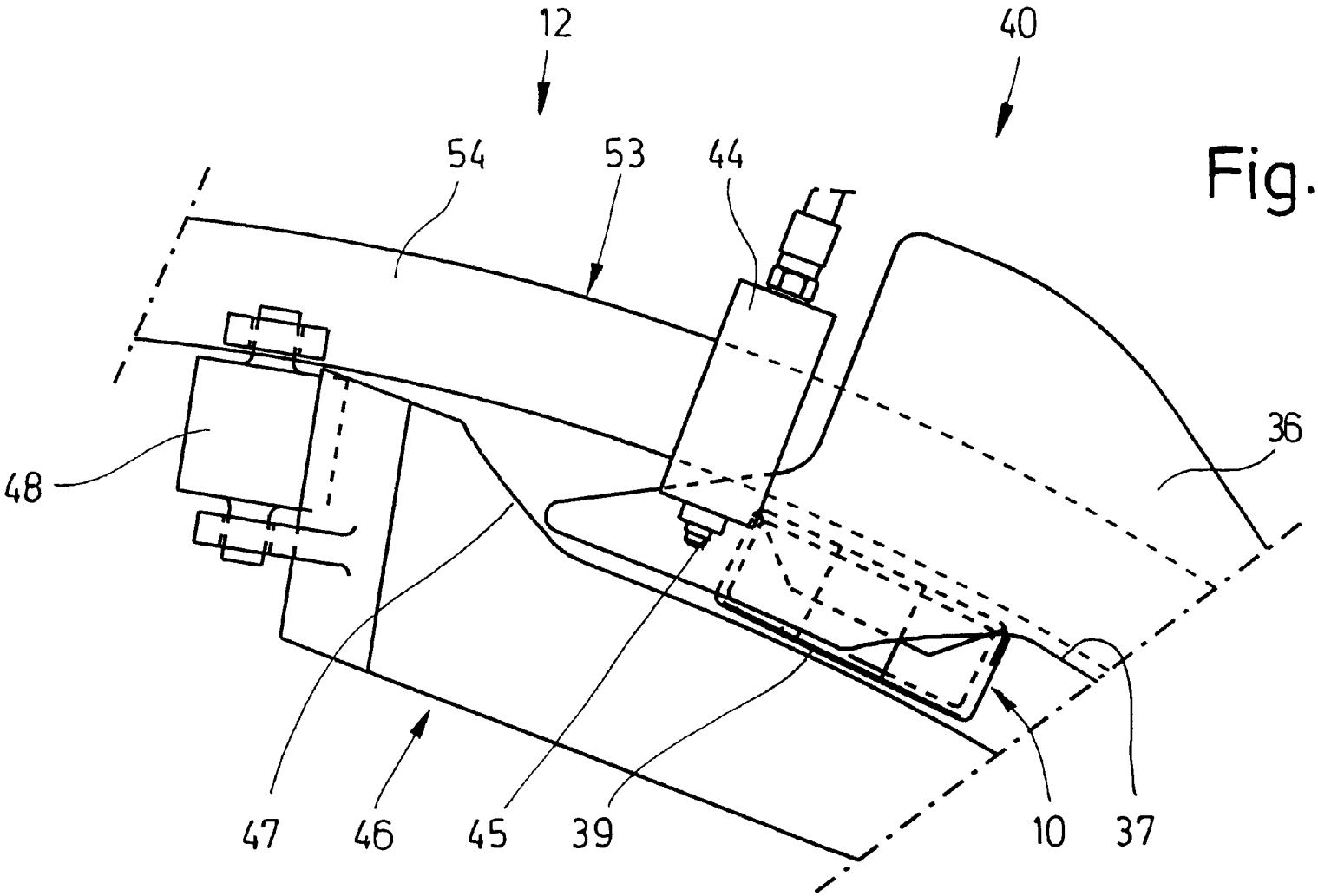
Figure 10:
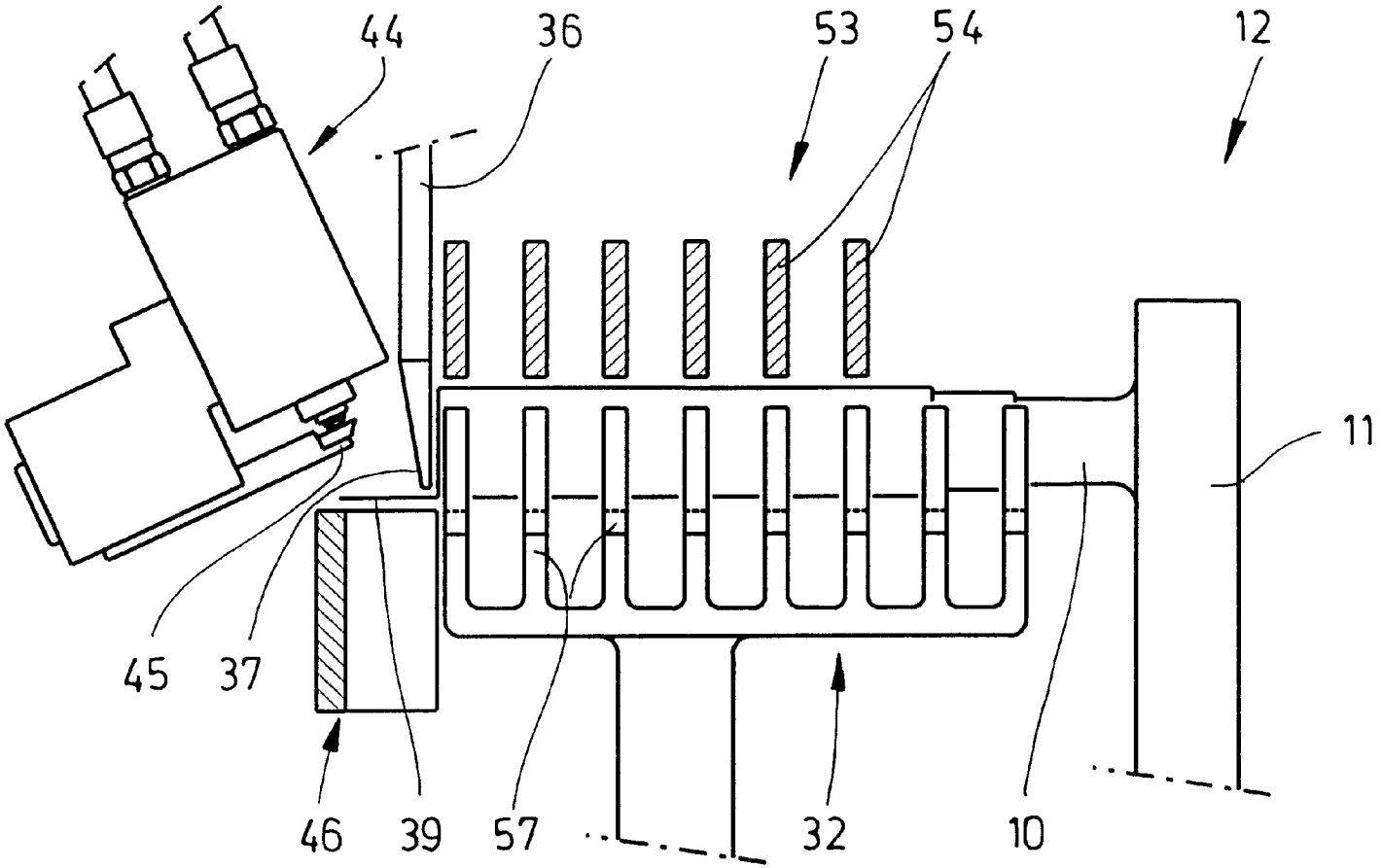

A region, lying on the outside in a radial direction, of the folding wings 58, including the folding fingers 59, is likewise configured like a comb (FIG. 8). The parallel folding webs 60 so formed are arranged off-set to the webs 54 of the external guide 53, and, on rotation of the folding wheel 31, enter the spaces between the webs 54. The positions are so chosen in the present case that the webs 54 lie approximately in the same plane as the folding webs 57 of folding means 32. The folding webs 60 of the folding wheel 31 lie in the plane of the webs 51 of the support 50.

The support 50, lying radially on the inside, ends in the region of the folding station 30 or at the end of same. In the region of the base gluing station 40, a guide for the blank of the soft pouch 18 is not provided on the side lying radially on the inside. Only on the outside, beside the movement path of the folding mandrels, does the web 52 form a continuation, as base folding means 46 for the base flap 39.

Following the completion of the base wall of the soft pouch 18, the cigarette group is led in usual fashion using the ram 49 into the folding mandrel and thus into the packet.

Further details of the rotary folding unit can be configured in appropriate fashion, for example according to DE 35 45 884. In addition, the described process steps and details of the device are also suitable for the production of other packets, for example for the production of packets of the hinge-lid type made of (thin) cardboard.

What is claimed is:

1. A method for manufacturing a soft pack for a cigarrette group with a continously moving blank made of thin packaging material which completely surrounds the cigarrette group, wherein longitudinally extending pack inner and outer side flaps (24, 25) are formed which overlap each other and are glued to one another, and wherein in a region of a pack base wall, longitudinally extending pack inner and outer base flaps (38, 39) are formed which likewise overlap each other and which are glued to one, said method comprising the steps:

a) placing the blank in U-shaped fashion around a folding mandrel (10) of a continously rotating folding unit (12) rotating about an axis, in such a way that the side flaps (24, 25), on a rear side of the folding mandrel (10) relative to a moving direction of the mandrel, project over said folding mandrel;

b) folding an overhang of the blank, at a free end of the folding mandrel (10), for the base flaps (38, 39)

c) pivoting an outer face of the inner side flap (24), by means of a stationary gluing assembly (28) with first glue spots (26);

d) causing the gluing assembly (28) to apply to said outer face a row of a plurality of the glue spots (26) spaced apart and extending in the longitudinal direction of the inner flap (24);

e) applying the glue spots (26), during the continuous movement of the blank, by a plurality of non-contacting glue nozzles (29) of the gluing assembly (28) which are arranged next to each other in a direction parallel to said axis of said folding unit (12);

f) simultaneously actuating the glue nozzles (29), in synchronization with the continuous rotation of the rotary folding unit (12), to transfer one portion of glue per glue nozzle (29) to form one of the glue spots (26); and g) applying on an inner surface of the outer base flap (39) of the continuously moving blank a plurality of second glue spots (41), following the longitudinal direction of the outer base flap (39), during the continuous rotation movement of the rotary folding unit (12), with a stationary gluing member (44) having a single non-contacting glue nozzle (45), by successively actuating the single glue nozzle (45) during the continuous rotational movement of the rotary folding unit (12).

2. The method according to claim 1, further comprising the steps of:

folding edge flaps (22, 33) of the blank, which project over the folding mandrel (10), to form the base flaps (38, 39) as trapezoids with triangular folding gussets (43) at opposite ends thereof, and applying the plurality of second spots (41) only in a region between the folding gussets (43) on the outer base flap (39).

3. The method according to claim 1, further comprising the steps of:

first folding the inner base flap (38) into a plane of the base wall, and then providing the outer base flap (39) with the second glue spots (41), and then folding over the outer base flap (39) onto the inner base flap (38).

4. The method according to claim 2, further comprising the steps of:

first folding the inner base flap (38) into a plane of the base wall, and then providing the outer base flap (39) with the second glue spots (41), and then folding over the outer base flap (39) onto the inner base flap (38).

5. A method for manufacturing a soft pack for a cigarette group with a continuously moving blank made of thin packaging material which completely surrounds the cigarette group, wherein longitudinally extending pack inner and outer side flaps (24, 25) are formed which overlap each other and are glued to one another, and wherein in a region of a pack base wall, longitudinally extending pack inner and outer base flaps (38, 39) are formed which likewise overlap each other and which are glued to one another, said method comprising the steps of:

a) placing the blank in U-shaped fashion around a folding mandrel (10) of a continuously rotating folding unit (12) rotating about an axis, in such a way that the side flaps (24, 25), on a rear side of the folding mandrel (10) relative to a moving direction of the mandrel, project over said folding mandrel;

b) folding an overhang of the blank, at a free end of the folding mandrel (10), for the base flaps (38, 39);

c) folding in edge flaps (22, 33) of the overhang to make the base flaps (38, 39) trapezoid-shaped;

d) during the continuous movement of the rotary folding unit (12), providing, on an inner face of the outer base flap (39) of the continuously moving blank, a row of glue spots (41) running in the direction of said movement; and e) applying the glue spots (41) to said inner face, through only a single non-contacting glue nozzle (45) of a stationary gluing member (44), by successively and cyclically actuating the glue nozzle (45) to produce successive delivery of individual glue spots during the continuous movement of the rotary folding unit (12).

6. A device for manufacturing soft-pouch packs for cigarettes, wherein blanks made of thin packaging material are continuously conveyed in a conveying direction by folding mandrels (10) of a rotary folding unit (12) rotating about an axis, said device comprising, disposed outside a movement path of the folding mandrels (10), a plurality of folding members for folding longitudinally extending folding flaps of the blanks, said device further comprising:

a) outside the movement path of the folding mandrels (10), a stationary gluing assembly (28) having a plurality of non-contacting glue nozzles (29), spaced from the movement path, for transferring glue spots (26) to the flaps of each moving blank, said glue nozzles (29) being directed radially toward the axis of the rotary folding unit (12), b) the folding flaps of each moving blank including an inner side flap (24) of a soft pouch (18), and wherein an outer surface of the inner side flap (24) faces the glue nozzles (29) as the blank moves past the gluing assembly (28), c) wherein, in order to apply a row of spaced glue spots (26), running transversely to the conveying direction, to the inner side flap (24), said glue nozzles are disposed beside one another in the axial direction of the rotary folding unit (12); and means for simultaneously actuating the nozzles to transfer one spot portion of glue per nozzle in a radial direction to the outer surface of the inner side flap (24).

7. The device according to claim 6, wherein the folding flaps of each blank include an inner (38) and an outer (39) base flap, and further comprising:

for transferring glue spots (41) to the outer base flap (39) with its longitudinal dimension extending in the conveying direction of the folding mandrels (10), a single glue nozzle (45) disposed beside and spaced from the movement path of the folding mandrels; and means for actuating said single nozzle to transfer, in short cycles, glue spots in succession to the passing outer base flap (39).

8. The device according to claim 7, wherein the single glue nozzle (45) is directed at an oblique angle to a plane of the outer base flap (39).

9. The device according to claim 7, further comprising a translationally fixed rotating pressure roller (28) which, once the inner and outer base flaps (38, 39) have been folded and glued, presses them together to fix them.

10. The device according to claim 6, wherein said rotary folding unit (12) is disposed along a part of the circular movement path of the folding mandrels (10), and further comprising support members, arranged radially outside and inside of the movement path, for the blanks on the folding mandrels (10), the support members comprising a plurality of webs (51, 54) spaced from one another in an axial direction, said folding members being configured like a comb, so that the folding members move partly past the webs (51, 54).

11. The device according to claim 10, further comprising a folding wheel (31) for folding the inner side flap (24), projecting above the folding mandrels (10) and lying radially on the outside of the movement path, said folding wheel (31) having a plurality of distributed folding wings (58), with folding fingers (59) at ends of same, which also are configured like a comb and which enter the spaces between webs (54) to carry out folding of the folding flaps.

* * * * *